US009840787B2

(12) United States Patent
Kitada et al.

(10) Patent No.: US 9,840,787 B2
(45) Date of Patent: Dec. 12, 2017

(54) CERAMIC ELECTRONIC COMPONENT AND MANUFACTURING METHOD THEREFOR

(71) Applicant: Murata Manufacturing Co., Ltd., Nagaokakyo-shi, Kyoto-fu (JP)

(72) Inventors: Eriko Kitada, Nagaokakyo (JP); Hiromasa Ito, Nagaokakyo (JP); Tsutomu Sasaki, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 116 days.

(21) Appl. No.: 14/963,298

(22) Filed: Dec. 9, 2015

(65) Prior Publication Data

US 2016/0090661 A1 Mar. 31, 2016

Related U.S. Application Data

(63) Continuation of application No. PCT/JP2014/062409, filed on May 8, 2014.

(30) Foreign Application Priority Data

Jun. 13, 2013 (JP) ..... 2013-124562

(51) Int. Cl.
*H01C 7/10* (2006.01)
*C25D 5/54* (2006.01)
(Continued)

(52) U.S. Cl.
CPC ..... *C25D 5/54* (2013.01); *C25D 5/12* (2013.01); *C25D 7/00* (2013.01); *H01C 1/14* (2013.01);
(Continued)

(58) Field of Classification Search
CPC ..... H01C 1/14; H01C 1/1406; H01C 1/1413; H01C 7/008; H01C 7/021; H01C 7/041
(Continued)

(56) References Cited

U.S. PATENT DOCUMENTS

2012/0056709 A1* 3/2012 Kajino ..... C01G 31/006 338/22 R
2012/0162838 A1 6/2012 Sawada et al.
(Continued)

FOREIGN PATENT DOCUMENTS

JP 05-251210 A 9/1993
JP 06-290989 A 10/1994
(Continued)

OTHER PUBLICATIONS

JP 2008-244119, Oct. 2008; Machine translation.*
(Continued)

*Primary Examiner* — Kyung Lee
(74) *Attorney, Agent, or Firm* — Keating & Bennett, LLP

(57) ABSTRACT

A ceramic electronic component includes a ceramic body, baked external electrodes, and plated external electrodes, and glass layers derived from a glass material included in a conductive paste of the baked external electrodes, are provided at interfaces between the baked external electrodes and the ceramic body, such that the glass layers extend from the interfaces between the ceramic body and the baked external electrodes to a surface of the ceramic body that does not contain the baked external electrodes.

17 Claims, 6 Drawing Sheets

(51) Int. Cl.

| | |
|---|---|
| ***H01C 1/14*** | (2006.01) |
| ***H01C 7/02*** | (2006.01) |
| ***H01C 7/04*** | (2006.01) |
| ***C25D 5/12*** | (2006.01) |
| ***C25D 7/00*** | (2006.01) |
| ***H01C 7/00*** | (2006.01) |

(52) U.S. Cl.
CPC ..... *H01C 1/1406* (2013.01); *H01C 1/1413* (2013.01); *H01C 7/008* (2013.01); *H01C 7/021* (2013.01); *H01C 7/041* (2013.01); *H01C 7/042* (2013.01)

(58) Field of Classification Search
USPC ..... 338/22 R
See application file for complete search history.

(56) References Cited

U.S. PATENT DOCUMENTS

| | | | | |
|---|---|---|---|---|
| 2012/0250196 | A1 | 10/2012 | Sumi et al. | |
| 2013/0229256 | A1* | 9/2013 | Miura | H01C 7/043 338/22 R |
| 2015/0070127 | A1* | 3/2015 | Ikeda | H01C 7/04 338/22 R |

FOREIGN PATENT DOCUMENTS

| | | | |
|---|---|---|---|
| JP | 2007-273256 | A | 10/2007 |
| JP | 2008-244119 | A | 10/2008 |
| JP | 2008-251630 | A | 10/2008 |
| JP | 2011-129884 | A | 6/2011 |
| JP | 2012-074269 | A | 4/2012 |
| WO | 2011/040435 | A1 | 4/2011 |

OTHER PUBLICATIONS

Official Communication issued in International Patent Application No. PCT/JP2014/062409, dated Aug. 5, 2014.
Official Communication issued in corresponding Japanese Patent Application No. 2015-522651, dated Dec. 13, 2016.

* cited by examiner

CERAMIC ELECTRONIC COMPONENT AND MANUFACTURING METHOD THEREFOR

BACKGROUND OF THE INVENTION

1. Field of the Invention

The present invention relates to a ceramic electronic component including a baked external electrode formed by baking a conductive paste onto a ceramic body, and a plated external electrode on the surface of the baked external electrode, more particularly, to a ceramic electronic component in which a glass layer derived from a glass material included in a conductive paste is located on the surface of a ceramic body near an outer edge of a baked external electrode.

In addition, the present invention relates to a method for manufacturing a ceramic electronic component.

2. Description of the Related Art

For ceramic electronic components, conductive pastes may be baked onto ceramic bodies to form baked external electrodes, and plated external electrodes may be further formed by plating on the surfaces of the baked external electrodes. The plated external electrodes are formed for the purpose of, for example, improving solderability for mounting, or protecting the baked external electrodes.

For example, in the case of a plated external electrode with a first layer composed of a Ni layer and a second layer composed of a Sn layer from a baked external electrode, the Ni plated layer for the first layer protects the baked external electrode from so-called solder corrosion, and the Sn plated layer for the second layer contributes to improved solderability.

In this regard, plating steps for ceramic electronic components are typically carried out by electrolytic plating, and the plating solutions used are often strongly acidic.

In such plating steps, in the case of ingress of the strongly acidic plating solutions between the ceramic bodies and the baked external electrodes, the solutions erode the ceramic bodies just below outer edges of the baked external electrodes. Moreover, when water adheres to the eroded portions for some reason while using the eroded ceramic electronic components mounted on electronic devices, the metals of the external electrodes are ionized to cause migration in a direction of electric field.

There has been a possibility that the migration will serve as discharge paths to cause short-circuits, and thus break the ceramic electronic components.

In addition, in the ceramic electronic components, the ceramic bodies may be conductive, for example, like thermistors. Further, in the case of forming plated external electrodes for such conductive ceramic bodies, plated films may adhere to not only the surfaces of the plated external electrodes, but also the surfaces of the ceramic bodies, to which the films really should not adhere. Further, when the external electrodes are connected with the plated films adhering to the surfaces of the ceramic bodies, there is a possibility that the external electrodes will be short-circuited to cause defects.

Therefore, for conventional ceramic electronic components, in plating steps, various efforts have been made so as to keep portions of ceramic elements just below outer edges of baked external electrodes from being eroded by plating solutions, and so as to keep plated films from adhering to the surfaces of the ceramic elements even when the ceramic elements are conductive.

For example, the ceramic electronic component (conductive chip-type ceramic element) 300 described in JP 5-251210 A is manufactured by the following method.

First, an unfired ceramic body 101 is prepared as shown in FIG. 7A.

Next, as shown in FIG. 7B, the unfired ceramic body 101 is subjected to firing to obtain a fired ceramic body 102.

Next, as shown in FIG. 7C, an insulating inorganic layer 103 of 0.1 μm to 2 μm in thickness, which is composed of a $SiO_2$ film, a thin film of oxides such as $SiO_2$ and $Al_2O_3$, or a thin film of glass containing, as its main constituent, an oxide such as $SiO_2$, is formed over the entire surface of the fired ceramic body 102 by a physical vapor deposition method (PVD method) or a chemical vapor deposition method (CVD method), such as a vacuum deposition method, a sputtering method, or an ion plating method. This inorganic layer 103 is required to have a higher melting point or softening point than a firing temperature in the case of forming baked electrodes as will be described later.

Next, as shown in FIG. 7D, a conductive paste 104 including a metal powder such as Ag or Au and an inorganic binder is applied by a dipping method or the like to the surfaces of both ends of the ceramic body 102 with the inorganic layer 103 formed over the entire surface. Examples of the inorganic binder include glass microparticles such as borosilicate based glass, zinc borate based glass, cadmium borate based glass, and lead zinc silicate based glass, which contain an oxide such as $SiO_2$ as their main constituent. The inorganic binder is uniformly dispersed in the conductive paste 104 applied.

Next, as shown in FIG. 7E, the conductive paste 104 applied to the surfaces of the both ends of the ceramic body 102 is baked to form baked external electrodes (baked electrode layers) 105. In this case, the inorganic binder in the conductive paste 104 reacts the inorganic substance layer 103 in contact with the conductive paste 104 to melt the inorganic substance layer 103. Then, the melted inorganic substance layer 103 is incorporated into the conductive paste 104. This results in the absence of the inorganic substance layer 103 between the ceramic body 102 and the baked external electrodes 105.

Next, as shown in FIG. 7F, Ni plated external electrodes (Ni plated layers) 106 are formed on the surfaces of the baked external electrodes 105.

Finally, as shown in FIG. 7G, Sn plated external electrodes (Sn plated layers) 107 are formed on the surfaces of the Ni plated external electrodes 106 to complete the conventional ceramic electronic component 300.

In the formation of the Ni plated external electrodes 106 and the formation of the Sn plated external electrodes 107, because the surface of the ceramic body 102 without the baked external electrodes 105 formed is protected by the inorganic substance layer 103, portions of the ceramic body 102 just below outer edges of the baked external electrodes 105 will not be eroded by plating solutions, or plated films will not adhere to the surface of the ceramic body 102.

In addition, the ceramic electronic component (chip circuit component) 400 described in JP 6-290989 A is manufactured by the following method.

First, a chip ceramic body 201 is prepared as shown in FIG. 8A.

Next, as shown in FIG. 8B, a resist 202 such as a maskant ink is applied to end surfaces of the ceramic body 201 by means such as, for example, a dip method, and subjected to curing.

Next, in this condition, the ceramic body 201 is put in a vacuum deposition system, and as shown in FIG. 8C, a protective film material is deposited over the entire surface to form a protective film 203. This protective film 203 is an amorphous thin film composed of an inorganic substance such as, for example, amorphous aluminum oxide, silicon oxide, or zirconium oxide. It is to be noted that the protective film 203 can be also formed by spray pyrolysis methods, chemical vapor deposition (CVD), and sputtering methods, besides physical vapor deposition methods.

Next, the resist 202 on the both ends of the ceramic body 201 is removed as shown in FIG. 8D. Thus, the protective film 203 over the end surfaces of the ceramic body 201 is also removed along with the resist 202, and the protective film 203 is left only on both side surfaces and top and bottom surfaces of the ceramic body 201.

Next, as shown in FIG. 8E, a conductive paste such as an Ag paste is applied by means such as a dip method to both ends of the ceramic body 201 with the protective film 203 formed, which have no protective film 203 provided, and baked to form baked external electrodes (conductor films) 204.

Next, as shown in FIG. 8F, Ni plated external electrodes (conductor films) 205 are formed on the surfaces of the baked external electrodes 204.

Finally, as shown in FIG. 8G, Sn plated external electrodes (conductor films) 206 are formed on the surfaces of the Ni plated external electrodes 205 to complete the conventional ceramic electronic component 400. It is to be noted that solder-plated external electrodes may be adopted in place of the Sn plated external electrodes 206.

In the formation of the Ni plated external electrodes 205 and the formation of the Sn plated external electrodes 206, because the surface of the ceramic body 201 without the baked external electrodes 204 formed is protected by the inorganic substance layer 203, portions of the ceramic body 201 just below outer edges of the baked external electrodes 204 will not be eroded by plating solutions, or plated films will not adhere to the surface of the ceramic body 201.

The prior art mentioned above has the following problems.

First, the method described in JP 5-251210 A requires the extra step of forming the insulating inorganic layer 103 over the entire surface of the fired ceramic body 102 as shown in FIG. 7C. This inorganic substance layer 103 has to be formed by a physical vapor deposition method (PVD method) or a chemical vapor deposition method (CVD method), such as a vacuum deposition method, a sputtering method, or an ion plating method, and the formation has the problems of cumbersome manufacture, increased length of manufacturing time, and increased cost.

In addition, while large numbers of products are manufactured simultaneously in mass production processes, the inorganic substance layer 103 of oxide or glass is formed over the entire surface of the ceramic body 102 in the method described in JP 5-251210 A, and there is thus a possibility that a plurality of ceramic bodies 102 will adhere to each other, or the ceramic body 102 will adhere to a firing tool, e.g., when the glass paste 104 is baked onto the ceramic body 102 to form the baked external electrodes 105. More specifically, there has been a possibility of decreasing the yield.

Moreover, in the method described in JP 5-251210 A, the melted inorganic substance layer 103 is absorbed by the inorganic binder in the glass paste 104 when the glass paste 104 is baked onto the ceramic body 102 to form the baked external electrodes 105 as shown in FIG. 7E, and in this case, there is a possibility that the composition of the inorganic binder will be altered to result in an excess reaction with the ceramic body 102, or glass layers will be formed on the surfaces of the baked external electrodes 105 formed. More specifically, there is a possibility that new defective products will be generated due to the altered composition of the inorganic binder.

On the other hand, the method described in JP 6-290989 A requires the step of applying the resist 202 such as a maskant ink by means such as a dip method as shown in FIG. 8B, the step of curing the applied resist 202, the step of forming the protective film 203 over the entire surface of the ceramic body 201 by a physical vapor deposition method, a spray pyrolysis method, a chemical vapor deposition (CVD), a sputtering method, or the like, as shown in FIG. 8C, the step of removing the resist 202 on the both ends of the ceramic body 201 as shown in FIG. 8D, etc., and has the problems of cumbersome manufacture, increased length of manufacturing time, and increased cost.

SUMMARY OF THE INVENTION

A ceramic electronic component according to a preferred embodiment of the present invention includes a ceramic body; a baked external electrode including a baked conductive paste including a conductive material and a glass material located on the ceramic body; and a plated external electrode located on the baked external electrode, wherein a glass layer derived from the glass material included in the conductive paste is located at an interface between the baked external electrode and the ceramic body, and the glass layer extends from the interface between the ceramic body and the baked external electrode to a surface of the ceramic body on which the baked external electrode is not located.

Furthermore, a method for manufacturing a ceramic electronic component according to another preferred embodiment of the present invention includes firing a ceramic body; applying a conductive paste including a conductive material and a glass material to the ceramic body; baking the applied conductive paste to form a baked external electrode on the ceramic body, and forming a glass layer derived from the glass material included in the conductive paste, to extend between the interface between the baked external electrode and the ceramic body, and from the interface to a surface of the ceramic body that does not contain the baked external electrode; and forming a plated external electrode on a surface of the baked external electrode.

Further, in a ceramic component according to a preferred embodiment of the present invention, and a method for manufacturing a ceramic electronic component according to a preferred embodiment of the present invention, preferably, the glass layer extending on the surface of the ceramic body extends about 10 μm or more from an outer edge of the baked external electrode, and the outer edge of the baked external electrode is not brought into contact with the surface of the ceramic body over the entire periphery. In this case, it is possible to further ensure that a portion of the ceramic element just below an outer edge of the baked external electrode is prevented from being eroded by plating solutions, and that the external electrodes are prevented from being short-circuited by a plated film adhering to the surface of the ceramic element.

In addition, the temperature of baking the conductive paste onto the ceramic body is preferably about 30° C. or more higher than the softening point of the glass material included in the conductive paste. In this case, the glass layer is easily extended from the interface between the ceramic body and the baked external electrode to the surface of the ceramic body that does not contain the baked external electrode formed.

In addition, the glass layer preferably has a solubility in plating solution of about 3.3% or less after immersion for approximately 5 hours in a plating solution for use in forming the plated external electrode. In this case, the glass layer further ensures that the ceramic body is protected from plating solutions.

In addition, preferably, the ceramic body has a first basicity, the glass material included in the conductive paste has a second basicity, and the difference between the first basicity and the second basicity has an absolute value of about 0.21 or less (including a case in which the difference is 0 between the first basicity and the second basicity). In this case, the glass material and the ceramic body are prevented from excessively reacting, which may break the ceramic body.

Further, the conductive material may include at least one of, for example, Cu, an alloy containing Cu, Ag, an alloy containing Ag, Pd, and an alloy containing Pd.

In a ceramic electronic component according to a preferred embodiment of the present invention, the surface of the ceramic body near the outer edges of the baked external electrodes is protected by the glass layers in the formation of the plated external electrodes, and a portion of the ceramic body just below the outer edges of the baked external electrodes is thus not eroded by any plating solution. In addition, the external electrodes are prevented from being short-circuited by any plating film attached to the surface of the ceramic body. Furthermore, there is no need to add any special step for the manufacture.

In addition, a method for manufacturing a ceramic electronic component according to a preferred embodiment of the present invention can, without adding any special step, easily form the glass layer derived from the glass material included in the conductive paste, with the glass layer extended from the interface between the baked external electrode and the ceramic body to the surface of the ceramic body that does not contain the baked external electrode formed. Further, the glass layer formed to be extended protects the surface of the ceramic body near outer edges of the baked external electrode in the step of forming the plated external electrode, and portions of the ceramic element just below the outer edges of the baked external electrode are thus not eroded by plating solutions. In addition, the external electrodes are prevented from being short-circuited by any plating film attached to the surface of the ceramic element.

The above and other elements, features, steps, characteristics and advantages of the present invention will become more apparent from the following detailed description of the preferred embodiments with reference to the attached drawings.

BRIEF DESCRIPTION OF THE DRAWINGS

FIGS. 3A-3C, are respectively cross-sectional views illustrating steps that are applied in an example of a method for manufacturing the ceramic electronic component 100.

DETAILED DESCRIPTION OF THE PREFERRED EMBODIMENTS

Preferred embodiments of the present invention will be described below with reference to the drawings.

First Preferred Embodiment

Figure 1:
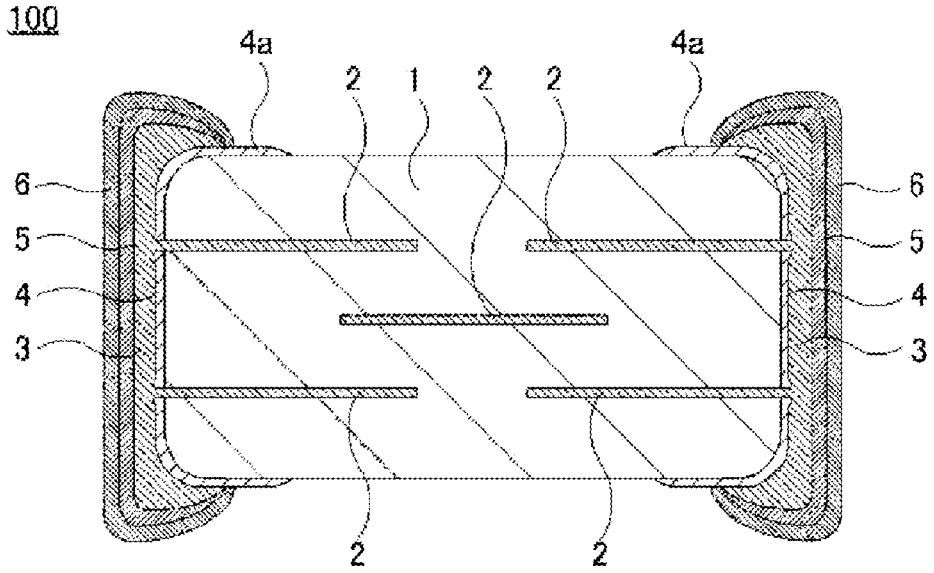
FIG. 1 is a cross-sectional view illustrating a ceramic electronic component 100 according to a first preferred embodiment of the present invention.
Figure 2:
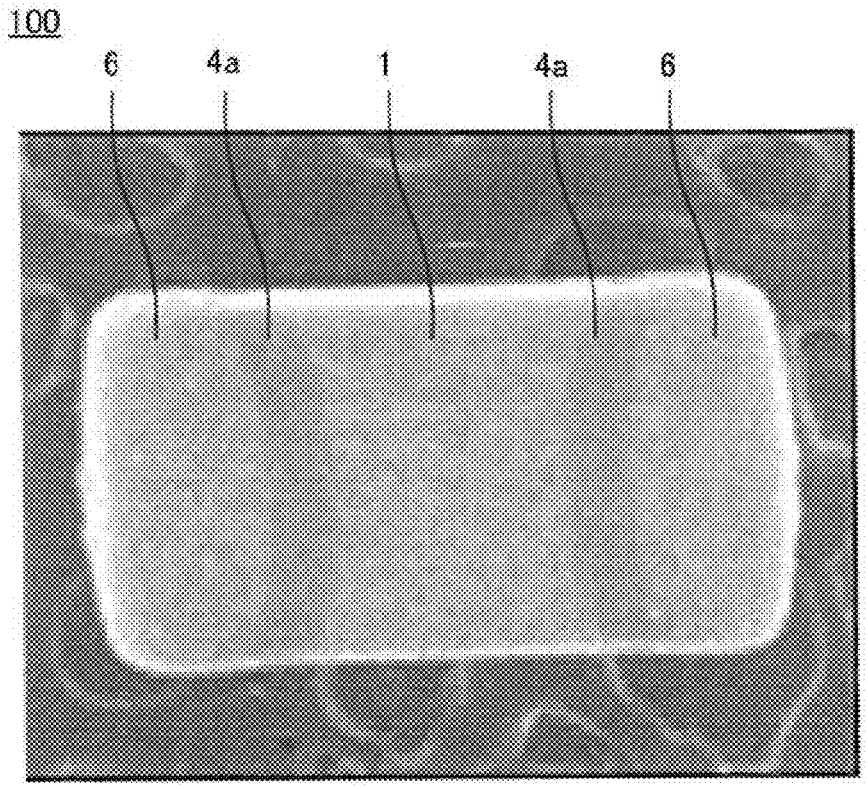
FIG. 2 is a scanning electron micrograph (SEM) of the ceramic electronic component 100 from above.

FIG. 1 is a cross-sectional view illustrating a ceramic electronic component 100 according to a first preferred embodiment of the present invention. In addition, FIG. 2 is a scanning electron micrograph of the ceramic electronic component 100 from above. It is to be noted that the appearance configurations of the ceramic electronic components 100 shown in FIGS. 1 and 2 fail to conform with each other, because scales on external electrode portions, etc. are adjusted (exaggeratingly shown) in FIG. 1 for the sake of illustration.

In the present preferred embodiment, the ceramic electronic component 100 is an NTC thermistor, that is, a thermistor with a negative temperature coefficient of resistance. However, the ceramic electronic component 100 is not to be considered limited to any NTC thermistor.

The ceramic electronic component 100 preferably has a size of, for example, 0.5 mm in width, 0.5 mm in height, and 1.0 mm in length.

The ceramic electronic component 100 includes a ceramic body 1. The ceramic electronic component 100 according to the present preferred embodiment includes internal electrodes 2 laminated within the ceramic body 1. It is to be noted that while the ceramic electronic component 100 includes the internal electrodes 2 laminated within the ceramic body 1, the internal electrodes 2 are not essential to the ceramic electronic component 100 according to a preferred embodiment of the present invention, but a ceramic body may be used which includes no internal electrodes 2. In addition, when the internal electrodes 2 are laminated within the ceramic body 1, the number of layers is arbitrary.

A conductive paste for external electrodes is applied to both ends of the ceramic body 1, and baked to form a pair of baked external electrodes 3. The baked external electrodes 3 are each connected to predetermined internal electrodes 2. In connection portions between the internal electrodes 2 and the baked external electrodes 3, a conductive material included in the internal electrodes 2 and a conductive material included in the baked external electrodes 3 diffuse mutually.

Glass layers 4 derived from a glass material (glass frit) contained in the conductive paste for the formation of the bake external electrodes 3 are located at the interfaces between the ceramic body 1 and the baked external electrodes 3.

The glass layers 4 include glass layer extensions 4*a* that extend from the interfaces between the ceramic body 1 and the baked external electrodes 3 to the surface of the ceramic body 1 that does not contain the baked external electrodes 3. It is to be noted that preferably, the glass layer extensions 4*a* preferably extend about 10 μm or more from outer edges of the baked external electrodes 4, and the outer edges of the baked external electrodes 3 are not brought into contact with the surface of the ceramic body 1 over the entire periphery. This is because the glass layer extensions 4*a* ensure the protection of the ceramic body 1 near the outer edges of the baked external electrodes 3 in the formation of Ni plated external electrodes 5 and Sn plated external electrodes 6 as will be described later in this case.

The glass layers 4, which are derived from the glass material contained in the conductive paste used for the formation of the baked external electrodes 3, may contain a glass material (component) contained in, e.g., the ceramic body 1 (the ceramic material used for the formation of the ceramic body 1) in some cases, and the cases also fall within the scope of the present invention.

Ni plated external electrodes 5 are located on the surfaces of the baked external electrodes 3.

Sn plated external electrodes 6 are located on the surfaces of the Ni plated external electrodes 5.

The ceramic electronic component 100 according to the present preferred embodiment, which is structured as described above, is manufactured by a method as shown in, for example, FIGS. 3A through 4E.

Figure 3A:
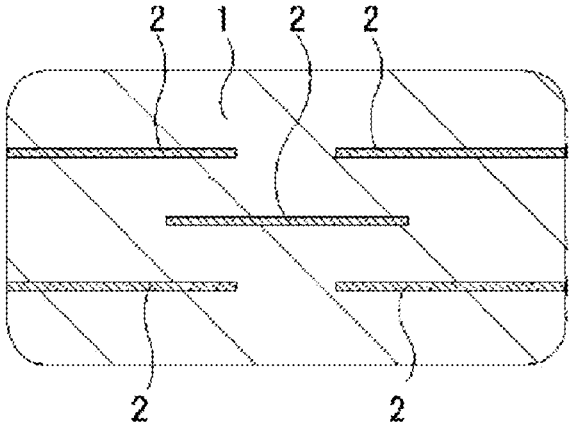
FIGS. 3A to 3C are respectively cross-sectional views illustrating steps that are applied in an example of a method for manufacturing the ceramic electronic component 100.

First, the ceramic body 1 with the internal electrodes 2 laminated therein is prepared as shown in FIG. 3A.

Specifically, first, predetermined starting raw materials are mixed in predetermined proportions to obtain a raw material.

While the composition of the ceramic constituting the ceramic body 1 prepared is arbitrarily specified, starting raw materials are selected so as to provide a desired ceramic composition, and mixed in predetermined proportions to obtain a raw material.

For example, the compositions (compositional systems) of samples C-1 to C-4 as shown in Table 1 can be adopted as the composition of the ceramic constituting the ceramic body 1.

TABLE 1

Compositional System and Basicity of Ceramic constituting Ceramic Body

| Sample Number | Compositional System | First Basicity $B_1$ |
|---|---|---|
| C-1 | Mn—Ni—Fe | 0.46 |
| C-2 | Mn—Ni—Al | 0.44 |
| C-3 | Mn—Ni—Fe—Ti | 0.48 |
| C-4 | Mn—Ni—Co—Al | 0.38 |

For example, the sample C-1 refers to a ceramic for Mn—Ni—Fe based NTC thermistor.

In order to obtain the ceramic of the sample C-1 for Mn—Ni—Fe based NTC thermistor, for example, $Mn_3O_4$, NiO, and $Fe_2O_3$ can be used for starting raw materials, and mixed in predetermined proportions to obtain the raw material.

Likewise, the samples C-2, C-3, and C-4 refer to a ceramic for Mn—Ni—Al based NTC thermistor, a ceramic for Mn—Ni—Fe—Ti based NTC thermistor, and a ceramic for Mn—Ni—Co—Ti based NTC thermistor, and for each of the ceramics, starting raw materials can be selected, and mixed in predetermined proportions to obtain the raw material.

Each ceramic used to form the ceramic body 1 has a basicity. In the present preferred embodiment, the basicity of the ceramic constituting the fired ceramic body 1 is referred to as a first basicity, and denoted by a symbol $B_1$.

The ceramics according to the samples C-1 to C-4, subjected to firing, each have the first basicity $B_1$ as listed in Table 1. For example, for the ceramic according to the sample C-1, mixing the $Mn_3O_4$, NiO, and $Fe_2O_3$ in the predetermined proportions has resulted in a first basicity $B_1$ of about 0.46, for example. Similarly, the ceramic according to the sample C-2 has achieved a first basicity $B_1$ of about 0.44, for example. The ceramic according to the sample C-3 has achieved a first basicity $B_1$ of about 0.48, for example. The ceramic according to the sample C-4 has achieved a first basicity $B_1$ of about 0.38, for example.

Next, the above-described raw materials are subjected to calcination, and subjected to grinding to obtain calcined powders.

Next, the calcined powder and an organic vehicle are mixed in predetermined proportions to obtain ceramic slurry. In this regard, a plasticizer, a dispersant, etc. are also mixed, if necessary.

Next, the ceramic slurry is subjected to sheet forming by a doctor blade method or the like, thus providing ceramic green sheets.

Next, the ceramic green sheets are subjected to punching into rectangular or substantially rectangular plates.

Next, if necessary, a conductive paste for internal electrodes is applied in predetermined shapes to the predetermined ceramic green sheets obtained by the punching, thus forming electrode patterns.

The conductive paste for internal electrodes preferably includes at least one conductive material of, for example, Cu, an alloy containing Cu, Ag, an alloy containing Ag, Pd, an alloy containing Pd, or the like; and an organic vehicle.

Next, the ceramic green sheets with the electrode patterns formed thereon and the ceramic green sheets without any electrode pattern formed thereon are stacked in predetermined order to reach a predetermined number of sheets, and brought into pressurization to obtain an unfired mother laminated body.

Next, the unfired mother laminated body is cut into the form of a chip to obtain an unfired ceramic body.

Next, the unfired ceramic body is subjected to firing in accordance with a predetermined profile to obtain the ceramic body 1. Then, if necessary, the ceramic body 1 is subjected to barrel polishing.

On the other hand, a conductive paste for baked external electrodes is prepared separately from the ceramic body 1.

The conductive paste for baked external electrodes includes a conductive material, glass frit, and an organic vehicle. The conductive paste for baked external electrodes may further include another minute amount of aid, if necessary, and may include unintended impurities.

The conductive material may preferably include at least one of, for example, Cu, an alloy containing Cu, Ag, an alloy containing Ag, Pd, and an alloy containing Pd.

As the glass frit, five types of glass frits according to samples G-1 to G-5 as shown in Tables 2 and 3 were prepared in the present preferred embodiment.

Table 2 shows compositions for each glass frit. Table 3 shows details of alkali metals and alkaline-earth metals in each glass frit. It is to be noted that in Table 2, the amount of BaO is not included in the alkaline-earth metals, because the BaO is listed separately.

For example, for the glass frit according to the sample G-1, the softening point ST is 529° C., the solubility in plating solution is 1.1%, and the second basicity $B_2$ has a value of 0.65.

TABLE 2

Composition of Glass Frit

| Sample Number | $Al_2O_3$ (weight %) | $B_2O_3$ (weight %) | BaO (weight %) | CuO (weight %) | $SiO_2$ (weight %) | $TiO_2$ (weight %) | ZnO (weight %) | ZrO (weight %) | Alkali Metal (weight %) | Alkaline-Earth Metal* (weight %) |
|---|---|---|---|---|---|---|---|---|---|---|
| G-1 | 6.9 | 15.1 | 49.4 | | 6.1 | | 17.7 | | | 4.8 |
| G-2 | 4.1 | 17 | | 5.7 | 50.4 | 2.1 | 3 | 6.5 | 11.2 | |
| G-3 | 5.7 | 16.3 | 24.2 | 4.8 | 26.6 | 0.8 | 13.3 | 2.1 | 4.4 | 1.8 |
| G-4 | 1.3 | 42.4 | | 4.8 | 8.8 | 2.8 | 31.6 | | 8.3 | |
| G-5 | 2.5 | 26.0 | | | 32.5 | | 24.3 | | 4.8 | 9.9 |

| Sample Number | Softening Point ST (° C.) | Solubility in Plating Solution** (%) | Second Basicity $B_2$ |
|---|---|---|---|
| G-1 | 529 | 1.1 | 0.7 |
| G-2 | 581 | 0.9 | 0.4 |
| G-3 | 583 | 1.0 | 0.5 |
| G-4 | 546 | 3.3 | 0.5 |
| G-5 | 820 | 10.7 | 0.4 |

*The alkaline-earth metals do not include the BaO stated separately.

**The solubility in plating solution refers to the solubility in the case of immersion for 5 hours in the Ni plating solution used.

TABLE 3

Compositional Details of Glass Frit (on Alkali Metals and Alkaline-Earth Metals)

| | Alkali Metal | | | | Alkaline-Earth Metal | | |
|---|---|---|---|---|---|---|---|
| Sample Number | $Na_2O$ (weight %) | $K_2O$ (weight %) | $Li_2O$ (weight %) | Total (weight %) | CaO (weight %) | SrO (weight %) | Total (weight %) |
| G-1 | | | | 0.0 | 4.5 | 0.3 | 4.8 |
| G-2 | | 7.8 | 3.4 | 11.2 | | | 0.0 |
| G-3 | 3.1 | | 1.4 | 4.4 | 1.84 | | 1.8 |
| G-4 | 6.4 | | 1.9 | 8.3 | | | 0.0 |
| G-5 | | | 4.8 | 4.8 | 9.9 | | 9.9 |

For example, the glass frit according to the sample G-1 contains 6.9 weight % of $Al_2O_3$, 15.1 weight % of $B_2O_3$, 49.4 weight % of BaO, 6.1 weight % of $SiO_2$, 17.7 weight % of ZnO, and 4.8 weight % of alkaline-earth metals, as shown in Table 2. The glass frit according to the sample G-1 contains no alkali metal. The alkaline-earth metals include 4.5 weight % of Ca and 0.3 weight % of SrO as shown in FIG. 3.

Similarly, the glass frits according to the samples G-2 to G-5 are each composed of the composition shown in Tables 2 and 3.

The glass frit according to the samples G-1 to G-5 preferably has a size on the order of about 1.4 μm to about 2.1 μm in average particle size in the form of milled powder.

Each of the glass frit G-1 to G-5 has a softening point (° C.), solubility in plating solution (%), and basicity. It is to be noted that the basicity of the glass frit included in the conductive paste for baked external electrodes is referred to as a second basicity and denoted by a symbol $B_2$ in the present preferred embodiment. In addition, hereinafter, the softening point (° C.) of the glass frit may be denoted by a symbol ST.

The solubility in plating solution was determined by how much the weight of baked glass was decreased with respect to the initial value, after each glass frit was kneaded with an organic vehicle, applied onto an alumina plate, baked, and immersed for 5 hours in a plating solution for the formation of plated external electrodes (when the plated external electrodes are each composed of multiple layers, a plating solution for the formation of plated external electrodes for first layers; a Ni plating solution in the present preferred embodiment) as will be described later.

For example, the composition shown in Table 4 can be used as the organic vehicle in the conductive paste for external electrodes according to the present preferred embodiment.

TABLE 4

Composition of Organic Vehicle

| | Resin | | |
|---|---|---|---|
| Sample Number | Acrylic Resin ($12 \times 10^4$) | Alkyd Resin ($8 \times 10^3$) | Solvent Terpineol |
| V-1 | 15 weight % | 5 weight % | 80 weight % |

For example, this organic vehicle contains: 15 weight % of an acrylic resin with a weight average molecular weight of $12\times10^4$; 5 weight % of an alkyd resin with a weight average molecular weight of $8\times10^3$; and 80 weight % of terpineol as a solvent.

The above-mentioned conductive material, glass frit, and organic vehicle are compounded, along with aids, if necessary, so as to provide a predetermined composition. Subsequently, the compounded materials are kneaded and dispersed with a triple roll mill to prepare a conductive paste for baked external electrodes.

Figure 3B:
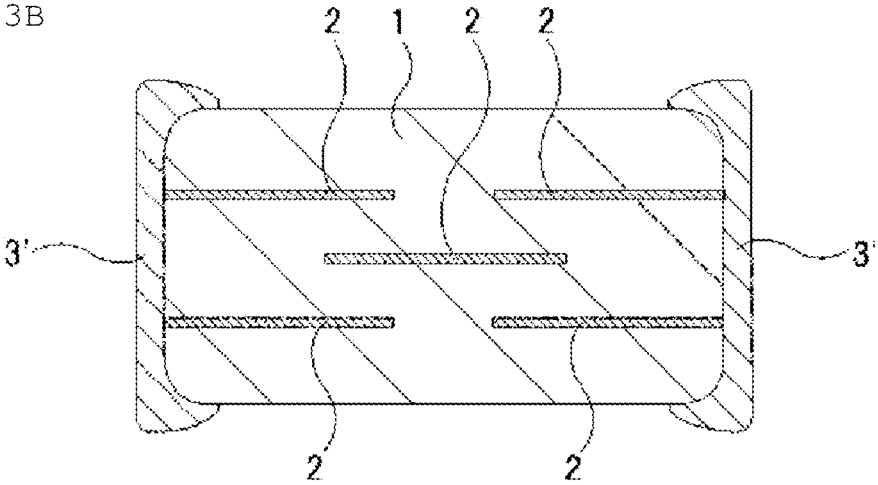

Next, as shown in FIG. 3B, a conductive paste 3' for baked external electrodes is applied to both ends of the ceramic body 1. The application can be achieved by, for example, a dip method.

Figure 5:
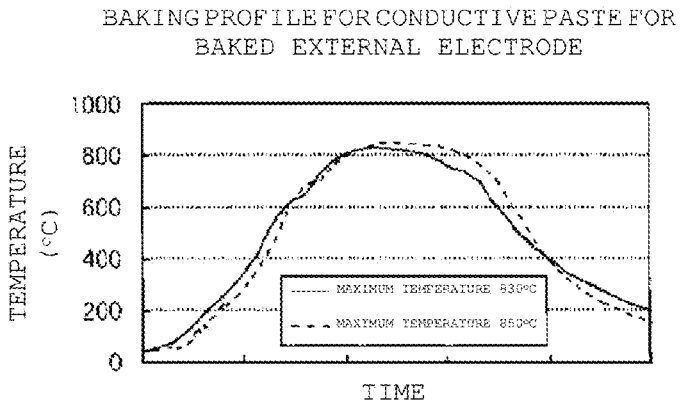
FIG. 5 is a graph showing two types of baking profiles in a step of baking a conductive paste for baked external electrodes of the ceramic electronic component 100 shown in FIG. 3C.

Next, the applied conductive paste 3' for baked external electrodes is baked onto the ceramic body 1, for example, in a tunnel furnace subjected to atmosphere control with the use of a mixed gas of $N_2$—$H_2$—$O_2$, for example, in accordance with a profile with a maximum temperature of 830° C. (solid line) or a profile with a maximum temperature of 850° C. (dashed line) as shown in FIG. 5. It is to be noted that hereinafter, the maximum temperature of the baking profile for the conductive paste for baked external electrodes may be denoted by a symbol BT.

Figure 3C:
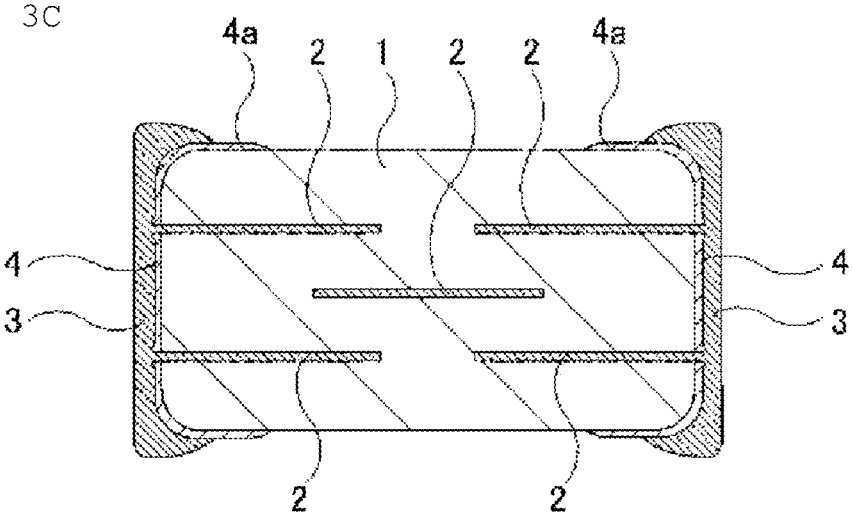

As a result, as shown in FIG. 3C, a pair of baked external electrodes 3 is formed on both ends of the ceramic body 1. The baked external electrodes 3 are each connected to predetermined internal electrodes 2. In connection portions between the internal electrodes 2 and the baked external electrodes 3, a conductive material included in the internal electrodes 2 and a conductive material included in the baked external electrodes 3 diffuse mutually.

Furthermore, the glass layers 4 derived from the glass material contained in the conductive paste for the formation of the bake external electrodes 3 are formed at the interfaces between the ceramic body 1 and the baked external electrodes 3.

In addition, the glass layers 4 include the glass layer extensions 4*a* from the interfaces between the ceramic body 1 and the baked external electrodes 3 to the surface of the ceramic body 1 that does not contain the baked external electrodes 3. The extended lengths of the glass layer extensions 4*a* are preferably longer in order to protect, from plating solutions, the ceramic body 1 just below outer edges of the baked external electrodes 3. It is to be noted that the extended lengths of the glass layer extensions 4*a* are affected mainly by the composition of the glass frit contained in the conductive paste for baked external electrodes, the maximum temperature in the case of baking the conductive paste for baked external electrodes, and the period of time for keeping at a temperature equal to or higher than the softening point of the glass frit. When the maximum temperature BT of the baking profile is about 30° C. or more higher than the softening point ST of the glass frit contained in the conductive paste, for example, the extended lengths of the glass layer extensions 4*a* can be about 10 μm or more in the case of many types of glass frits, for example.

The glass layers 4, which are derived from the glass material contained in the conductive paste for baked external electrodes, may contain a glass material (component) contained in, e.g., the ceramic material used for the formation of the ceramic body 1 in some cases, and the cases also fall within the scope of the present invention.

Figure 4D:
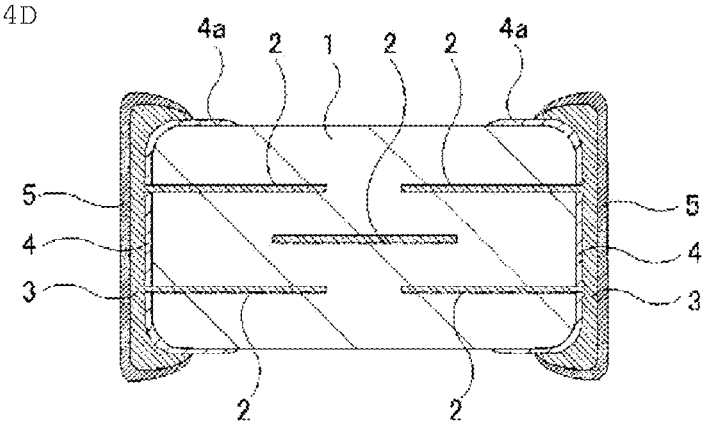
FIGS. 4D and 4E, following
Figure 4E:
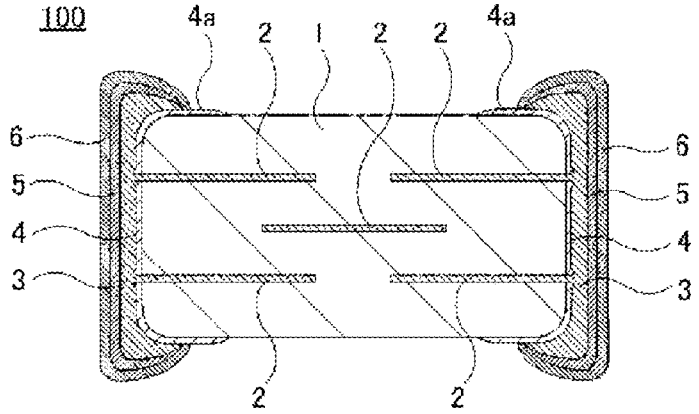

Next, as shown in FIG. 4D, the Ni plated external electrodes 5 are formed on the surfaces of the baked external electrodes 3 by a method that is used commonly in the process of manufacturing a chip ceramic electronic component. Subsequently, as shown in FIG. 4E, the Sn plated external electrodes 6 are formed on the surfaces of the Ni plated external electrodes 5 similarly by a method that is used commonly in the process of manufacturing a chip ceramic electronic component, thus completing the ceramic electronic component 100 according to the present preferred embodiment. In the formation of the Ni plated external electrodes 5 and Sn plated external electrodes 6, the presence of the glass layer extensions 4*a* keeps a portion of the ceramic body 1 just below the outer edges of the baked external electrodes 3 from being eroded by plating solutions. In addition, the presence of the glass layer extensions 4*a* prevents the external electrodes from being short-circuited by any plated film attached on the surface of the ceramic body 1.

Second Preferred Embodiment

Figure 6:
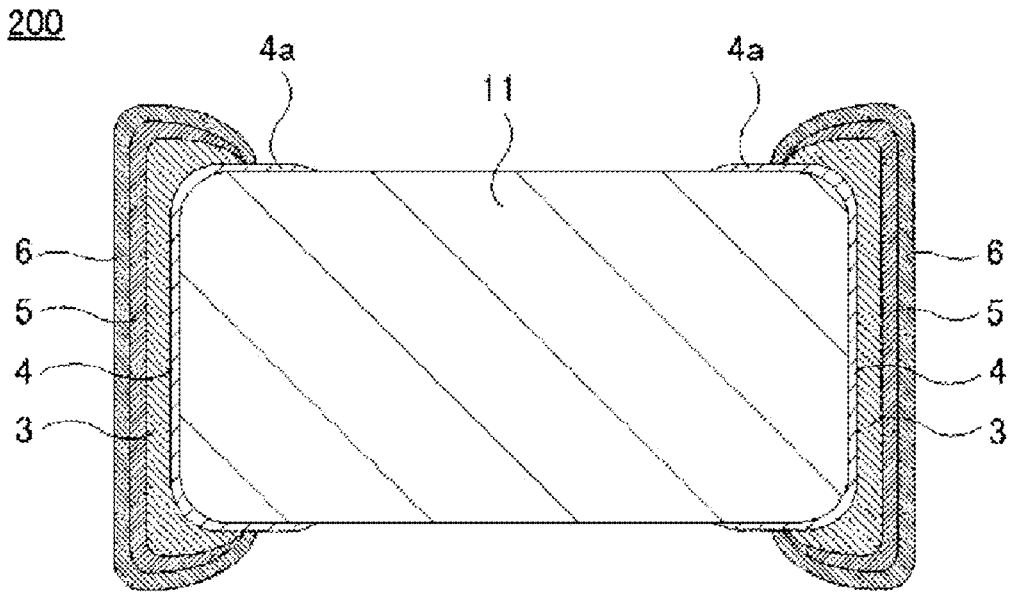
FIG. 6 is a cross-sectional view illustrating a ceramic electronic component 200 according to a second preferred embodiment of the present invention.
Figure 7A:
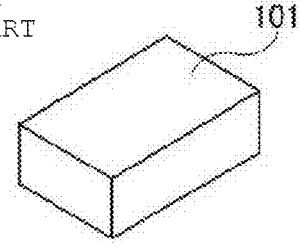
FIG. 7A PRIOR ART
FIGS. 7A to 7G are respectively perspective views illustrating steps that are applied in a method for manufacturing a conventional electronic component 300.
Figure 7B:
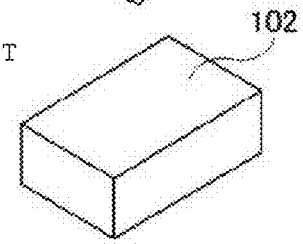
FIG. 7B PRIOR ART
Figure 7C:
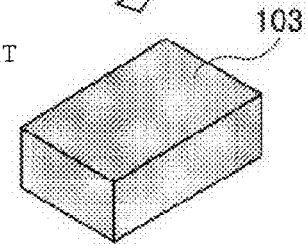
FIG. 7C PRIOR ART
Figure 7D:
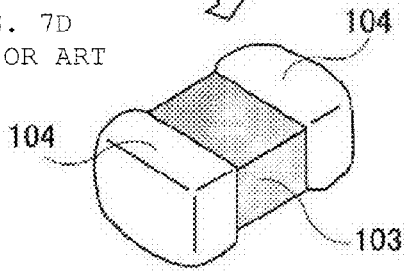
FIG. 7D PRIOR ART
Figure 7E:
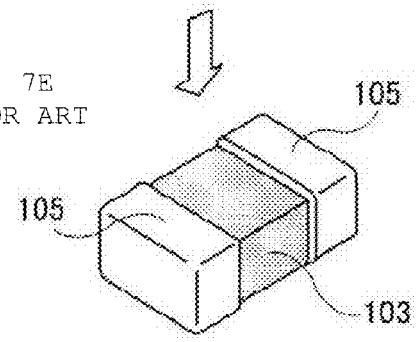
FIG. 7E PRIOR ART
Figure 7F:
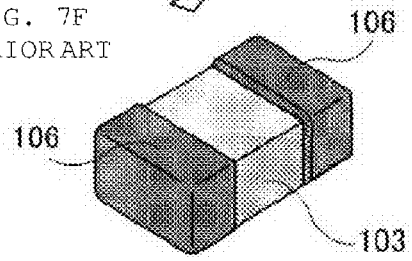
FIG. 7F PRIOR ART
Figure 7G:
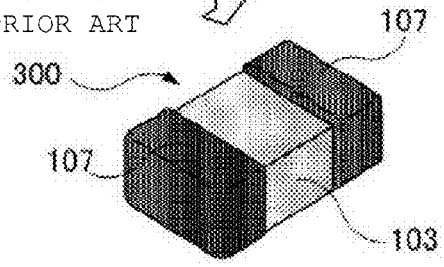
FIG. 7G PRIOR ART
Figure 8A:
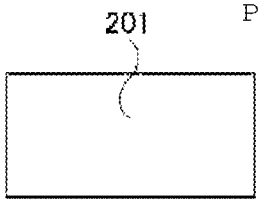
FIG. 8A PRIOR ART
FIGS. 8A to 8G are respectively perspective views illustrating steps that are applied in a method for manufacturing a conventional electronic component 400.
Figure 8B:
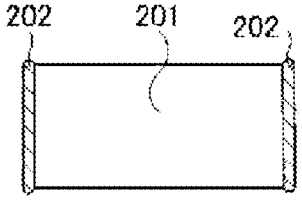
FIG. 8B PRIOR ART
Figure 8C:
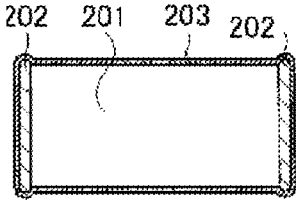
FIG. 8C PRIOR ART
Figure 8D:
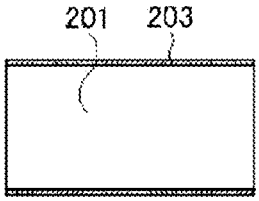
FIG. 8D PRIOR ART
Figure 8E:
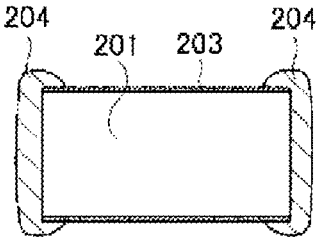
FIG. 8E PRIOR ART
Figure 8F:
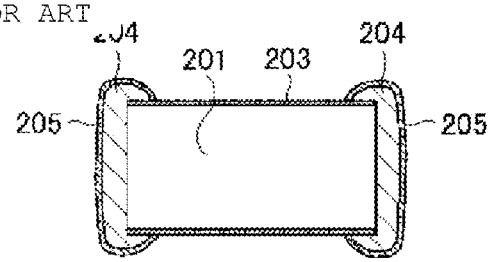
FIG. 8F PRIOR ART
Figure 8G:
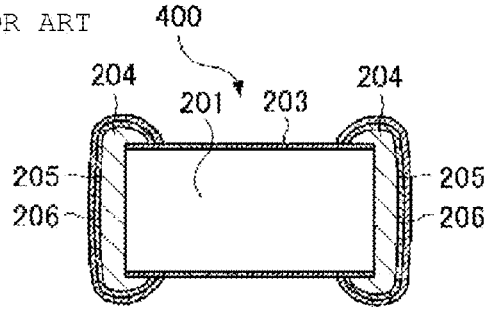
FIG. 8G PRIOR ART

FIG. 6 shows a cross-sectional view of a ceramic electronic component 200 according to a second preferred embodiment of the present invention.

The ceramic electronic component 200 differs, as compared with the ceramic electronic component 100 according to the first preferred embodiment as shown in FIG. 1, in that no internal electrode is provided within the ceramic body 11. The other configuration of the ceramic electronic component 200 is the same as the ceramic electronic component 100. It is to be noted that the ceramic body 11 is brought into contact with (electrically connected to) baked external electrodes 3 through portion that form no glass layer (not shown), which are generated in the form of, for example, balls, in glass layers 4 present at the interfaces between both the body and electrodes in the ceramic electronic component 200.

It is to be noted that in order not to form any internal electrode within the ceramic body 11 like the ceramic electronic component 200, only ceramic green sheets without any electrode pattern for defining an internal electrode may be stacked when ceramic green sheets are stacked, and brought into pressurization to prepare an unfired mother laminated body.

The structure of the ceramic electronic component 100 according to the first preferred embodiment, an example of a manufacturing method therefor, and the structure of the ceramic electronic component 200 according to the second preferred embodiment have been described above. However, the present invention is not to be considered limited to the foregoing content, but various changes, modifications, combinations, and variations can be made within the scope of the present invention.

For example, while NTC thermistors have been presented as the ceramic electronic component 100 according to the first preferred embodiment and the ceramic electronic component 200 according to the second preferred embodiment, the types of the ceramic electronic components are not limited to the NTC thermistors, but may be PTC thermistors or other ceramic electronic components.

EXAMPLE

Examples of eleven types of ceramic electronic components (NTC thermistors) according to samples 1 to 11 as shown in Table 5 were produced. The same structure as the ceramic electronic component 100 according to the first preferred embodiment as shown in FIG. 1 was adopted for the structures of the ceramic electronic components according to the samples 1 to 11. In addition, the methods for manufacturing the ceramic electronic components according to the samples 1 to 11 relied on the same manufacturing method as the method for manufacturing the ceramic electronic component 100 according to the first preferred embodiment as shown in FIGS. 3A through 4E. It is to be noted that fifty pieces were produced for each of the ceramic electronic components according to the samples 1 to 11.

TABLE 5

Composition of Conductive Paste for External Electrode and Composition, Evaluation, etc. of Ceramic Body

| | | Composition of Conductive Paste for Baked External Electrode | | | | Difference | | Evaluation | | |
|---|---|---|---|---|---|---|---|---|---|---|
| Sample Number | Composition of Ceramic Body (First Basicity $B_1$) | Glass Frit (Second Basicity $B_2$) (Softening Point ST) (Solubility in Plating Solution) 25.2 volume % | Conductive Material 4.5 volume % | Organic Vehicle 70.3 volume % | Baking Maximum Temperature for Baked External Electrode (BT) | between Baked Maximum Temperature and Softening Temperature of Glass Frit (BT − ST) | $\lvert\Delta B\rvert$ ($\lvert B_1 - B_2\rvert$) | Presence or Absence of Glass Layer Extention Formed | Plating Solution Resistance of Glass Layer | Excess Reaction between Glass Material and Ceramic Body |
| 1 | C-1 (0.46) | G-1 (0.65) (529° C.) (1.1%) | Cu | V-1 | 830° C. | 301° C. | 0.19 | ○ | ○ | ○ |
| 2 | C-1 (0.46) | G-2 (0.40) (581° C.) (0.9%) | Cu | V-1 | 830° C. | 250° C. | 0.06 | ○ | ○ | ○ |
| 3 | C-1 (0.46) | G-3 (0.45) (583° C.) (1.0%) | Cu | V-1 | 830° C. | 247° C. | 0.01 | ○ | ○ | ○ |
| 4 | C-1 (0.46) | G-4 (0.47) (546° C.) (3.3%) | Cu | V-1 | 830° C. | 284° C. | 0.01 | ○ | ○ | ○ |
| 5 | C-1 (0.46) | G-5 (0.35) (820° C.) (10.7%) | Cu | V-1 | 830° C. | 10° C. | 0.11 | X | Evaluation impossible | ○ |
| 6 | C-2 (0.44) | G-1 (0.65) (529° C.) (1.1%) | Cu | V-1 | 830° C. | 301° C. | 0.21 | ○ | ○ | ○ |
| 7 | C-3 (0.48) | G-1 (0.65) (529° C.) (1.1%) | Cu | V-1 | 830° C. | 301° C. | 0.17 | ○ | ○ | ○ |
| 8 | C-4 (0.38) | G-1 (0.65) (529° C.) (1.1%) | Cu | V-1 | 830° C. | 301° C. | 0.27 | ○ | ○ | Δ (the ceramic may have a crack defect or the like caused) |
| 9 | C-1 (0.46) | G-5 (0.35) (820° C.) (10.7%) | Cu | V-1 | 850° C. | 30° C. | 0.11 | ○ | Δ (the ceramic body may be eroded just below outer edges of the baked external electrodes) | ○ |
| 10 | C-1 (0.46) | G-1 (0.65) (529° C.) (1.1%) | Ag | V-1 | 830° C. | 301° C. | 0.19 | ○ | ○ | ○ |
| 11 | C-1 (0.46) | G-1 (0.65) (529° C.) (1.1%) | Ag/Pd = 95/5 | V-1 | 830° C. | 301° C. | 0.19 | ○ | ○ | ○ |

For the ceramic bodies, the four types of ceramic bodies were prepared according to the samples C-1 to C-4 as shown in Table 1. The ceramic bodies according to the samples C-1 to C-4 each have the first basicity $B_1$. Specifically, the first basicity $B_1$ of the ceramic according to the sample C-1 is about 0.46, for example. The first basicity $B_1$ of the ceramic according to the sample C-2 is about 0.44, for example. The first basicity $B_1$ of the ceramic according to the sample C-3 is about 0.48, for example. The first basicity $B_1$ of the ceramic according to the sample C-4 is about 0.38, for example.

The conductive paste for baked external electrodes includes glass frit, a conductive material, and an organic vehicle. In the present example, the glass frit, the conductive material, and the organic vehicle were compounded respectively in the proportions of about 25.2 volume %, about 4.5 volume %, and about 70.3 volume %.

For the glass frit, the five types of glass frits were prepared according to samples G-1 to G-5 as shown in Tables 2 and 3. Each glass frit according to the samples G-1 to G-5 has a second basicity $B_2$, a softening point ST, and solubility in plating solution.

For example, the second basicity $B_2$ of the glass frit according to the sample G-1 is 0.65, the softening point ST thereof is 529° C., and the solubility thereof in plating solution is 1.1%. The glass frits according to the samples G-2 to G-5 have second basicities $B_2$, softening points ST, and solubility in plating solution as listed in Table 2.

For the conductive material, three types of materials: Cu; Ag; and an alloy of Ag and Pd (Ag is 95 weight %, Pd is 5 weight %) were prepared.

For the organic vehicle, the organic vehicle of sample number V-1 was prepared as shown in Table 4.

The conductive paste for baked external electrodes was baked onto the ceramic body in accordance with either the profile with the maximum temperature BT of 830° C. (solid line) or the profile with the maximum temperature BT of 850° C. (dashed line) as shown in FIG. 5.

The ceramic electronic components according to each of the samples 1 to 11 prepared were evaluated for: "Presence or Absence of Glass Layer Extension Formed", that is, whether glass layer extensions were formed or not; "Plating Solution Resistance of Glass Layer", that is, whether the surface of the ceramic body just below outer edges of the baked external electrodes were eroded or not after the formation of the plated external electrodes; and "Excess Reaction between Glass Material and Ceramic Body", that is, whether the ceramic body was damaged or not in baking the conductive paste for baked external electrodes onto the ceramic body.

The inventors have discovered that the "Presence or Absence of Glass Layer Extension Formed" is affected by the relationship between the maximum temperature BT in the case of baking the conductive paste for baked external electrodes and the softening point ST of the glass material (glass frit) included in the conductive paste for baked external electrodes.

In addition, the inventors have discovered that the "Plating Solution Resistance of Glass Layer" is affected by the solubility in plating solution, of the glass material (glass frit) included in the conductive paste for baked external electrodes.

In addition, the inventors have discovered that the "Excess Reaction between Glass Material and Ceramic Body" is affected by the relationship between the basicity (first basicity $B_1$) of the ceramic body and the basicity (second basicity $B_2$) of the glass material (glass frit) included in the conductive paste for baked external electrodes.

Explanations will be given below in order.

First, as for "Presence or Absence of Glass Layer Extension", a case where glass layer extensions of 10 μm or more in length were formed from the outer edges of the baked external electrodes was regarded as "○", whereas a case where no glass layer extension was formed, or glass layers extensions were less than 10 μm, if any, was regarded as "×". The glass layer extensions were distinguished between the lengths of 10 μm or more and the lengths less than 10 μm, depending on a separately obtained finding that the glass layer extensions protect the surface of the ceramic body just under the outer edges of the baked external electrodes from plating solutions as long as the extensions are 10 μm or more, while the protection is insufficient when the extensions are less than 10 μm.

As can be seen from Table 5, the "Presence or Absence of Glass Layer Extension Formed" was regarded as "○" in the ceramic electronic components according to samples 1 to 4 and 6 to 11 with a difference (BT−ST) of 30° C. or more between the maximum temperature BT in the case of baking the conductive paste for baked external electrodes and the softening point ST of the glass material included in the conductive paste for baked external electrodes. On the other hand, the "Presence or Absence of Glass Layer Extension Formed" was regarded as "×" in the ceramic electronic component according to a sample 5 with the difference of less than 30° C. (10° C.). From the foregoing, it has been determined that the difference (BT−ST) between the maximum temperature BT in the case of baking the conductive paste for baked external electrodes and the softening point ST of the glass material included in the conductive paste for baked external electrodes is preferably adjusted to about 30° C. or more in order to form glass layer extensions of about 10 μm or more, for example.

As for the "Plating Solution Resistance of Glass Layer", whether the surface of the ceramic body just below the outer edges of the baked external electrodes was eroded or not was checked after the formation of the plated external electrodes, and for each sample, a case where the pieces (fifty) were not eroded at all was regarded as "○", a case where some of the pieces were eroded was regarded as "Δ", and a case where the pieces were all eroded was regarded as "×".

As can be seen from Table 5, the "Plating Solution Resistance of Glass Layer" was regarded as "○" in the ceramic electronic components according to the samples 1 to 4, 6 to 8, 10, and 11 with the solubility in plating solution of 3.3% or less, of the glass material included in the conductive paste for baked external electrodes. The ceramic electronic component according to the sample 5 with the solubility in plating solution of 10.7% failed to form glass layer extensions in the first place, and it was impossible to make an evaluation of "Plating Solution Resistance of Glass Layer". As for the ceramic electronic component according to the sample 9 with the solubility in plating solution of 10.7%, seventeen pieces were eroded among all the fifty pieces, and the "Plating Solution Resistance of Glass Layer" was thus regarded as "Δ". It is to be noted that there was no sample with the "Plating Solution Resistance of Glass Layer" regarded as "×". From the foregoing, it has been determined that the solubility in plating solution, of the glass material (glass frit) included in the conductive paste for baked external electrodes, is preferably adjusted to about 3.3% or less in order to protect, from plating solutions, the ceramic body just below the outer edges of the baked external electrodes.

As for the "Excess Reaction between Glass Material and Ceramic Body", it was checked whether surfaces of the ceramic body with the glass layers formed were broken or cracked by excess reaction between the glass material and the ceramic body or not, and for each sample, a case where the pieces (fifty) were not broken or cracked at all was regarded as "○", a case where some of the pieces were broken or cracked was regarded as "Δ", and a case where the pieces were all broken or cracked was regarded as "×".

As can be seen from Table 5, in the ceramic electronic components according to the samples 1 to 7 and 9 to 11 with the absolute value (hereinafter, referred to as $|\Delta B|$) of 0.21 or less for the difference ($B_1-B_2$) between the basicity (first basicity $B_1$) of the ceramic body and the basicity (second basicity $B_2$) of the glass material (glass frit) included in the conductive paste for baked external electrodes, the ceramic bodies were not broken or cracked, thus resulting in the "Excess Reaction between Glass Material and Ceramic Body" regarded as "○". As for the ceramic electronic component according to the sample 8 with the absolute value |ΔB| of 0.27, eight ceramic bodies were broken or cracked among all the fifty pieces, and the "Excess Reaction between Glass Material and Ceramic Body" was thus regarded as "Δ". It is to be noted that there was no sample with the Excess Reaction between Glass Material and Ceramic Body" regarded as "×".

In this regard, the value B (basicity) will be outlined. The basicity of an oxide melt can be represented by an average oxygen ion activity (conceptual basicity) calculated from the composition of an intended system.

The value B which is a basicity parameter is represented by the following formula (1).

$$B=\Sigma n_i \cdot B_i \quad (1)$$

In the formula (1), $n_i$ represents a cation fraction of a constituent i, and $B_i$ represents an oxygen donation ability of the constituent i. This $B_i$ is obtained from the following formulas (2) to (4).

The $M_i$-O bonding force of an oxide $M_iO$ can be represented by the attractive force $A_i$ between the cation and the oxygen ion. This $A_i$ is represented by the following formula (2).

$$A_i=Z_i \cdot Zo^{2-}/(r_i+ro^{2-})^2=2Z_i/(r_i+1.4)^2 \quad (2)$$

In this formula, $Z_i$ represents the valence of a cation from the constituent $M_i$. In addition, $r_i$ represents a cation radius of the constituent $M_i$, and the unit thereof is the angstrom. $Zo^{2-}$ represents the valence of an anion, and $ro^{2-}$ represents an anion radius.

The oxygen donation ability $B_i^0$ of the oxide $M_iO$ as a single constituent is given by the reciprocal of $A_i$, and thus represented by the following formula (3).

$$B_i^0=1/A_i \quad (3)$$

In this regard, in order to deal with the oxygen donation ability $B_i^0$ ideologically and quantitatively, the obtained value $B_i^0$ is turned into an indicator. Specifically, the $B_i^0$ obtained from the above formula (3) is substituted into the following formula (4) for recalculation. This makes it possible to deal with the basicity quantitatively for all oxides. It is to be noted that when the $B_i^0$ is turned into an indicator, the $B_i$ of CaO and the $B_i$ of $SiO_2$ are respectively defined as 1.000 ($B_i^0$=1.43) and 0.000 ($B_i^0$=0.41).

$$B_i=(B_i^0-B_{SiO2}^0)/(B_{CaO}^0-B_{SiO2}^0) \quad (4)$$

In this regard, when glass and ceramic are together subjected to firing, in general, as the absolute value (|ΔB|) is larger for the difference ($B_1-B_2$) in value B between the basicity (first basicity $B_1$) of the ceramic and the basicity (second basicity $B_2$) of the glass material, the glass is more likely to react with the ceramic, thus making a reaction layer more likely to be formed. Accordingly, it is theoretically possible to control the reactivity by the value of |ΔB|. However, in fact, the stronger reaction between the glass and the ceramic under the influence of the firing condition, etc. may lead to the ceramic altered, which is not theoretical.

As described above, the ceramic body was not broken or cracked by excess reaction between the glass material and the ceramic body in the ceramic electronic component with the |ΔB| of about 0.21 or less, whereas the ceramic body was broken or cracked by excess reaction between the glass material and the ceramic body in the ceramic electronic component with the |ΔB| in excess of about 0.21 (for example, the ceramic electronic component according to the sample 8 with the |ΔB| of 0.27).

Therefore, it has been determined that the |ΔB| is preferably adjusted to about 0.21 or less in order to prevent excess reaction between the glass material and the ceramic body.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A ceramic electronic component comprising:

a ceramic body;

a baked external electrode including a baked conductive paste including a conductive material and a glass material on the ceramic body; and a plated external electrode plated on a surface of the baked external electrode; wherein a glass layer derived from the glass material included in the conductive paste is provided at an interface between the baked external electrode and the ceramic body;

the ceramic body has a first basicity;

the glass material included in the conductive paste has a second basicity;

a difference between the first basicity and the second basicity has an absolute value of about 0.21 or less; and the glass layer extends from the interface between the ceramic body and the baked external electrode to a surface of the ceramic body that does not contain the baked external electrode.

2. The ceramic electronic component according to claim 1, wherein the glass layer extending on the surface of the ceramic body extends about 10 μm or more from an outer edge of the baked external electrode, and the outer edge of the baked external electrode does not contact with the surface of the ceramic body over an entire periphery.

3. The ceramic electronic component according to claim 1, wherein the conductive material comprises at least one of Cu, an alloy containing Cu, Ag, an alloy containing Ag, Pd, and an alloy containing Pd.

4. The ceramic electronic component according to claim 1, wherein the ceramic electronic component is one of an NTC thermistor and a PTC thermistor.

5. The ceramic electronic component according to claim 1, wherein the plated external electrode includes two plated layers.

6. The ceramic electronic component according to claim 1, wherein the plated external electrode includes a Ni plated external electrode plated on the baked external electrode.

7. The ceramic electronic component according to claim 6, further comprising an Sn plated external electrode plated on the Ni plated external electrode.

8. The ceramic electronic component according to claim 1, wherein the ceramic body includes internal electrodes connected to the plated external electrode.

9. A method for manufacturing a ceramic electronic component, the method comprising the steps of:

firing a ceramic body;

applying a conductive paste including a conductive material and a glass material to the ceramic body;

baking the applied conductive paste to form a baked external electrode on the ceramic body, and forming a glass layer derived from the glass material included in the conductive paste, to extend between an interface between the baked external electrode and the ceramic body, and from the interface to a surface of the ceramic body that does not contain the baked external electrode; and forming a plated external electrode on a surface of the baked external electrode;

wherein the ceramic body has a first basicity;

the glass material included in the conductive paste has a second basicity; and a difference between the first basicity and the second basicity has an absolute value of about 0.21 or less.

10. The method for manufacturing a ceramic electronic component according to claim 9, wherein the glass layer extending on the surface of the ceramic body extends about 10 μm or more from an outer edge of the baked external electrode, and the outer edge of the baked external electrode is not brought into contact with the surface of the ceramic body over an entire periphery.

11. The method for manufacturing a ceramic electronic component according to claim 9, wherein a temperature of baking the conductive paste is about 30° C. or more higher than a softening point of the glass material included in the conductive paste.

12. The method for manufacturing a ceramic electronic component according to claim 9, wherein the glass layer has a solubility in plating solution of about 3.3% or less after immersion for about 5 hours in a plating solution for use in the step of forming the plated external electrode.

13. The method for manufacturing a ceramic electronic component according to claim 9, wherein the ceramic electronic component is one of an NTC thermistor and a PTC thermistor.

14. The method for manufacturing a ceramic electronic component according to claim 9, wherein the plated external electrode includes two plated layers.

15. The method for manufacturing a ceramic electronic component according to claim 9, wherein the plated external electrode includes a Ni plated external electrode plated on the baked external electrode.

16. The method for manufacturing a ceramic electronic component according to claim 15, further comprising an Sn plated external electrode plated on the Ni plated external electrode.

17. The method for manufacturing a ceramic electronic component according to claim 9, wherein the ceramic body includes internal electrodes connected to the plated external electrode.

* * * * *